US007882581B2

(12) United States Patent
Felix, Jr. et al.

(10) Patent No.: US 7,882,581 B2
(45) Date of Patent: Feb. 8, 2011

(54) MODULAR FOUNDATION ASSEMBLIES FOR BEDS

(75) Inventors: Arthur R. Felix, Jr., Downey, CA (US); Dennis Rodgers, Orange, CA (US); Gary L. Hung, Alhambra, CA (US)

(73) Assignee: Felix Manufacturing Company, Inc., Compton, CA (US)

( * ) Notice: Subject to any disclaimer, the term of this patent is extended or adjusted under 35 U.S.C. 154(b) by 15 days.

(21) Appl. No.: 12/502,151

(22) Filed: Jul. 13, 2009

(65) Prior Publication Data

US 2010/0115696 A1 May 13, 2010

Related U.S. Application Data

(60) Provisional application No. 61/134,883, filed on Jul. 14, 2008.

(51) Int. Cl.
*A47C 19/02* (2006.01)

(52) U.S. Cl. ..... 5/200.1; 5/201; 5/285; 5/286; 5/238; 5/8

(58) Field of Classification Search ..... 5/8, 5/200.1, 201, 203, 205, 207, 236.1, 238, 5/285, 286, 400

See application file for complete search history.

(56) References Cited

U.S. PATENT DOCUMENTS

| | | | | |
|---|---|---|---|---|
| 3,633,224 | A * | 1/1972 | Millier | 5/18.1 |
| 5,758,372 | A * | 6/1998 | Lopez Diaz | 5/200.1 |
| 7,784,122 | B2 * | 8/2010 | Oh | 5/201 |
| 2005/0235417 | A1 * | 10/2005 | Koughan et al. | 5/400 |
| 2007/0151026 | A1 * | 7/2007 | Felix | 5/201 |
| 2009/0000030 | A1 * | 1/2009 | Hicks et al. | 5/400 |
| 2010/0154118 | A1 * | 6/2010 | Pearce | 5/201 |

* cited by examiner

*Primary Examiner*—Michael Trettel
(74) *Attorney, Agent, or Firm*—Christie, Parker & Hale, LLP

(57) ABSTRACT

A modular bed frame has ladder-like side frames with upper and lower side rails, and ladder-like end frames with upper and lower rails. The side and end frames telescopingly attach to the ends of upper and lower rounded corner rails on separate corner assemblies at the four corners of the assembled foundation. The rounded corner rails are rigidly supported as a unit by upright bracing members. The insides of the side frames carry tubular upright fittings for increasing vertical rigidity. These fittings support upwardly opening tubular sleeves that receive right angle corner connectors on the ends of spaced apart and parallel horizontal slats that traverse the bed frame from end to end when assembled by a user. Separate bed-elevating assemblies positioned at or near the corner connector assemblies elevate the assembled foundation above the floor.

2 Claims, 16 Drawing Sheets

MODULAR FOUNDATION ASSEMBLIES FOR BEDS

CROSS-REFERENCE TO RELATED APPLICATION(S)

This application claims the benefit of U.S. Provisional Patent Application No. 61/134,883, filed Jul. 14, 2008, the disclosure of which is hereby incorporated by reference.

FIELD OF THE INVENTION

This invention relates to foundations for use with mattresses in the bedding field, and more particularly, to a modular mattress-supporting foundation made of metal components easily assembled into a foundation which can replace the conventional frame and box spring assembly. One embodiment of the invention comprises a space-saving modular metal foundation frame assembly that provides storage space for a second bed frame, such as a trundle bed.

BACKGROUND OF THE INVENTION

Mattress-supporting foundations for conventional box springs are often made of wood frame members with a cloth outer cover. The conventional box springs are large and heavy. They require considerable storage space and therefore are expensive in stocking in inventory, especially in different sizes; and they have a high cost for transporting them from the factory to the customer or mattress manufacturer. Improvements are always sought in the expense of manufacturing, handling, assembling, and transporting bed foundations, and in the quality of the end product. U.S. Patent Publication 2007/0151026 to Felix discloses such an improved metal bed foundation assembly.

The present invention includes a metal bed foundation assembly manufactured in modular form and capable of being easily transported and assembled. The assembly components can be manufactured at a reasonably low cost while providing a high quality end product. The assembly avoids the retailer's cost of stocking conventional fully assembled box springs in inventory and the related higher cost of transporting them to the retailer or the user.

One embodiment of the invention provides a space-saving modular foundation configured and arranged to provide a lower storage area for use in storing a separate bed, such as a trundle bed, beneath the modular foundation.

SUMMARY OF THE INVENTION

Briefly, one embodiment of this invention provides a metal foundation assembly for a bed which comprises a modular system of tubular metal components which are easily assembled into the finished foundation. The components of the assembly are interconnected by slidably attaching side frames and end frames of the foundation to separate corner assemblies so that the foundation, in one embodiment, can be fully assembled without conventional fasteners.

One embodiment of the invention provides a modular foundation assembly having ladder-like side frames with upper and lower side rails and ladder-like end frames with upper and lower end rails. Separate corner connector assemblies are attached to the ends of the side frames and end frames at the corners of the assembled foundation. The corner connector assemblies, in one embodiment, include upper and lower corner rails each formed with a right angle bend. Separate laterally spaced apart tubular metal upright brace members are positioned between and rigidly affixed to the upper and lower corner rails, to support them at the top and bottom corners of the assembled foundation. The side frames slidably attach to corresponding tubular ends of the upper corner rails. The corner connector assemblies include a lower metal tubular end connector that slidably attaches to an end of the lower side rail on each of the ladder-like side frames. The end frames slidably attach to corresponding tubular ends of the upper and lower corner rails. The assembled corner connectors hold the side frames and end frames together to form a rigid rectangular box-frame structure, while the lower side rails of the side frames are spaced above the floor a sufficient distance to provide storage space beneath the foundation, to contain a separate bed frame, such as a trundle bed. In one embodiment, the trundle bed frame includes a foldable support structure with rollers or casters so that it may be placed beneath the foundation, for storage.

The insides of the side frames carry tubular fittings formed as slat connector sleeves for connection to laterally extending slats assembled between the side frames. The slat connector sleeves receive corner connectors on the ends of spaced apart slats that traverse the width of the box-frame structure when assembled by the user. The slats extend parallel to one another, perpendicular to the side frames, to provide lateral rigidity between the side frames.

Bed-elevating assemblies can be positioned at least near or on the four corner connector assemblies to engage rollers or casters or other leg structures for use in elevating the assembled foundation above the floor. In one embodiment, the bed-elevating assembly comprises elongated metal bottom slats that slidably fit into tubular metal sleeves affixed to the foundation, such as at the inside portions of the side frames. Alternatively, the metal bottom slats can slidably connect to lower inside portions of the corner assemblies. The bottom slats connect to casters or rollers used to support the foundation above the floor.

These and other aspects of the invention will be more fully understood by referring to the following detailed description and the accompanying drawings.

BRIEF DESCRIPTION OF THE DRAWINGS

FIG. 1 is a fragmentary perspective view showing the prior art assembled metal bed foundation.

FIG. 2 is an end elevational view taken on line 2-2 of FIG. 1.

FIG. 3 is a perspective view showing a corner connector.

FIG. 4 is a perspective view showing an end frame having releasably attached upper and lower end connectors.

FIG. 5 is a perspective view showing one of a plurality of slats.

FIG. 6 is a fragmentary side elevational view, partly in cross-section, showing a side frame bracing member supporting a upright slat connector sleeve for releasably receiving an end connector on a slat.

FIG. 7 is a fragmentary end elevational view, partly in cross-section, showing components of the FIG. 6 structure and including a leg connector sleeve for slidably receiving a leg portion of one of several feet that support the assembled foundation in an elevated position above the floor.

DETAILED DESCRIPTION

The present invention is best understood by first referring to FIGS. 1 to 7 which illustrate a prior art modular bed foundation.

Figure 1:
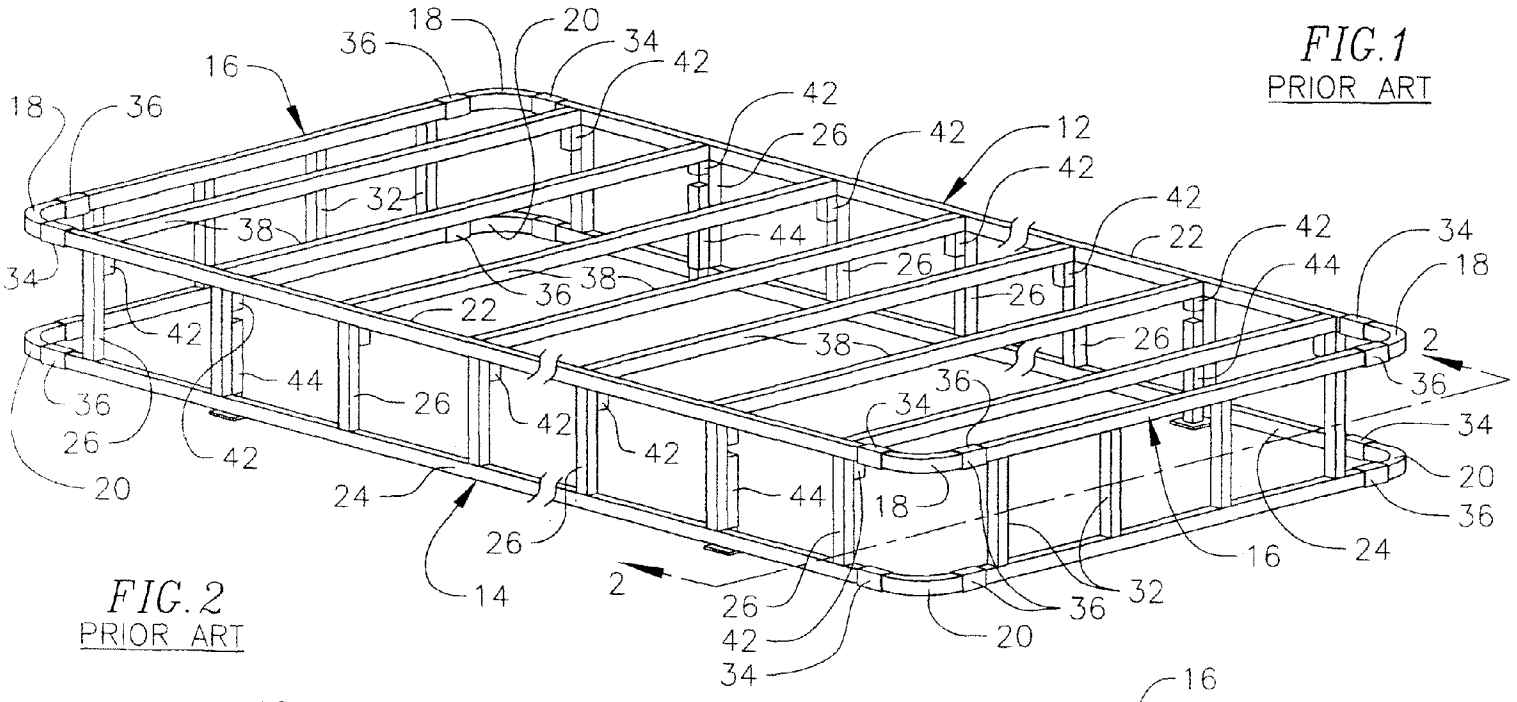
FIG. 1 PRIOR ART
FIGS. 1 to 7 illustrate components of a prior art metal bed foundation assembly, as disclosed in U.S. Patent Publication US 2007/0151026.
Figure 2:
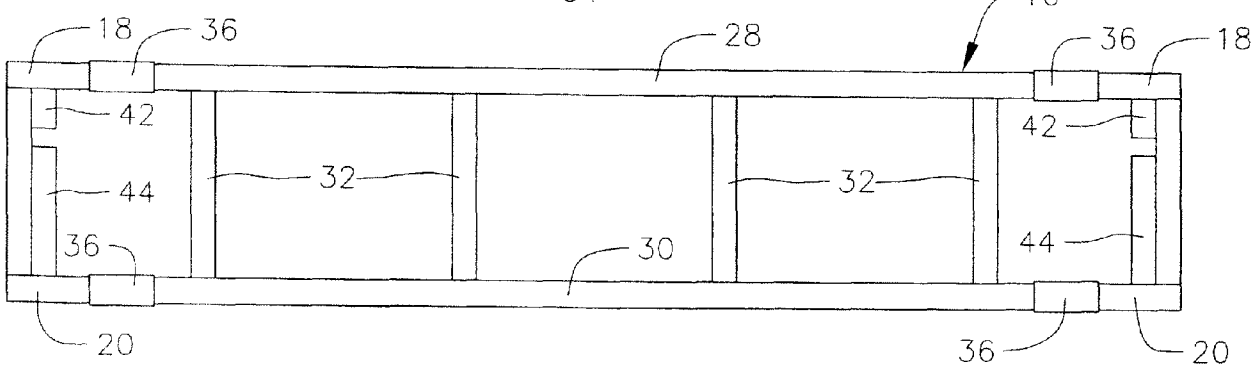
FIG. 2 PRIOR ART

Referring to FIGS. 1 and 2, a modular bed foundation assembly 10 includes left and right ladder-like side frames 12 and 14 respectively, ladder-like end frames 16, a set of four upper corner connectors 18, and a similar set of four lower corner connectors 20. The corner connectors are releasably secured to corresponding upper and lower end portions of the side frames and adjacent upper and lower end portions of the end frames at the four corners of the assembled foundation. The upper corner connectors each releasably connect a corresponding upper end portion of one of the side frames with an upper end portion of an adjacent end frame. Similarly, the lower corner connectors each releasably connect a corresponding lower end portion of one of the side frames with a lower end portion of an adjacent end frame. The corner connectors are assembled at the four corners of the foundation to rigidly hold the right and left side frames 12 and 14 in a fixed laterally spaced apart position, extending parallel to one another, while rigidly holding the end frames 16 in a fixed longitudinally spaced apart position, parallel to one another, at opposite ends of the assembled rectangular box-frame foundation assembly.

The left and right side frames each include corresponding upper and lower elongated tubular rigid metal side members 22 and 24, respectively, spaced apart vertically and extending substantially parallel to one another. A plurality of corresponding longitudinally spaced apart first rigid metal bracing members 26 are affixed in upright positions and extend parallel to one another to support the upper and lower tubular side members of each side frame. The first rigid metal bracing members 26 are preferably tubular metal frame members welded at opposite ends to the upper and lower side members.

The left and right end frames 16 each comprise corresponding upper and lower elongated tubular rigid metal end members 28 and 30. respectively, spaced apart vertically and extending parallel to one another. A plurality of corresponding laterally spaced apart second rigid metal bracing members 32 are rigidly affixed in upright positions extending parallel to one another for supporting the upper and lower tubular end members of each end frame. The second rigid metal bracing members 32 are preferably tubular metal frame members welded at opposite ends to the upper and lower end members.

Figure 3:
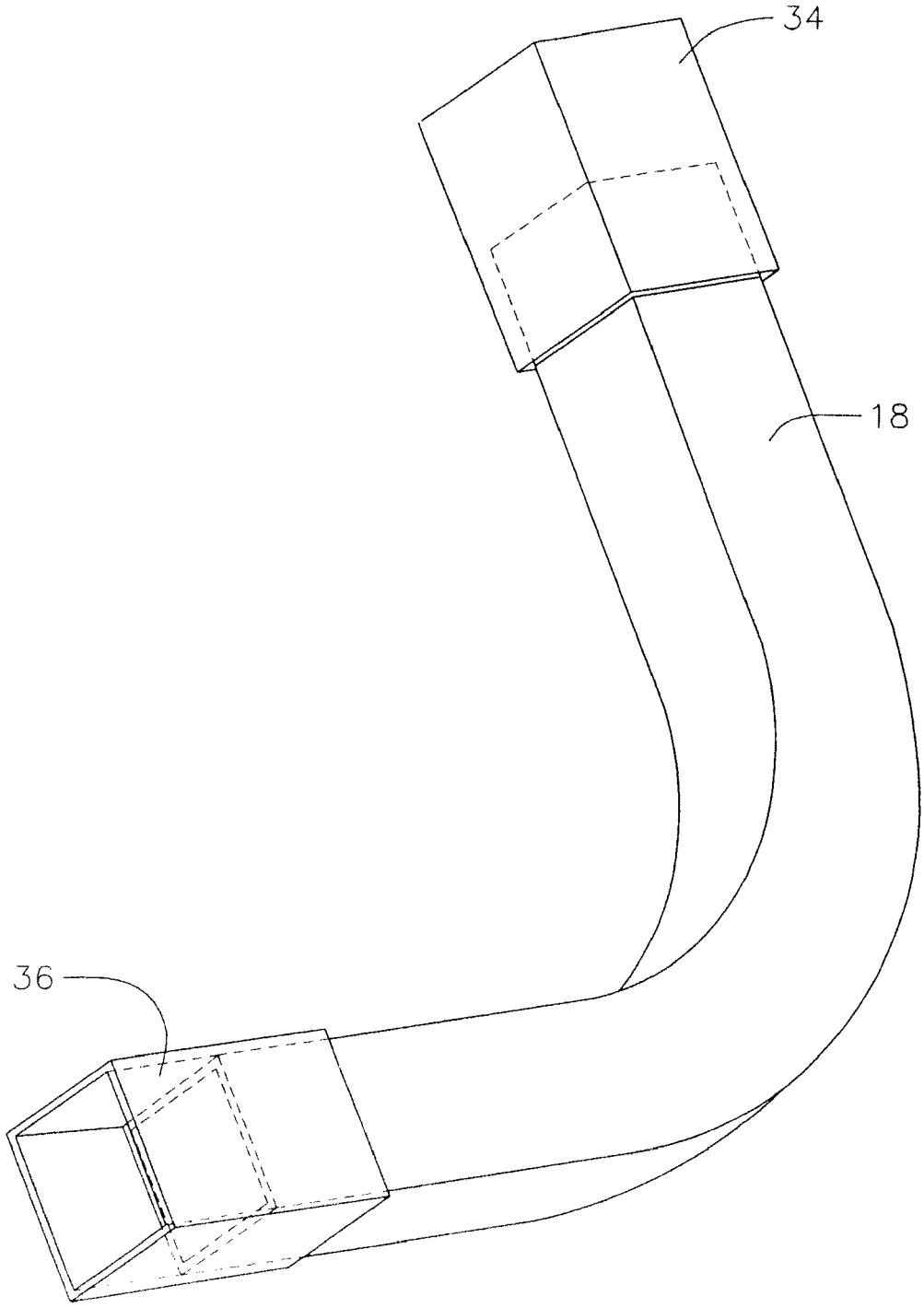
FIG. 3 PRIOR ART

Referring to FIG. 3, the corner connectors 18 each comprise a rigid metal frame member which is tubular in cross-section and bent into a generally right angle configuration, with a rounded central section. The straight end portions of the tubular corner connectors are elongated and extend along mutually perpendicular axes to form the right angle configuration. A rigid metal open ended connector sleeve 34 is rigidly affixed to one end of each corner connector. A separate open ended connector sleeve 36 is rigidly affixed to the other end of each corner connector. The connector sleeves 34 and 36 are rectangular in cross-section so that the interior of the corner sleeve 34 matches the rectangular exterior configuration of the upper or lower side members 22 or 24. The interior of the connector sleeve 36 matches the rectangular exterior configuration of the upper or lower end members 28 or 30. Thus, during assembly, the upper corner connectors releasably connect end portions of the upper side members to corresponding end portions of adjacent upper end members, and separate lower corner connectors releasably connect end portions of the lower side members to corresponding end portions of adjacent lower end members. The corner connectors in their connected positions, as shown in the assembled form of the foundation in FIG. 1, hold the side frames parallel to one another and hold the end frames parallel to one another to form the rectangular box-frame profile of the assembled foundation.

Figure 3A:
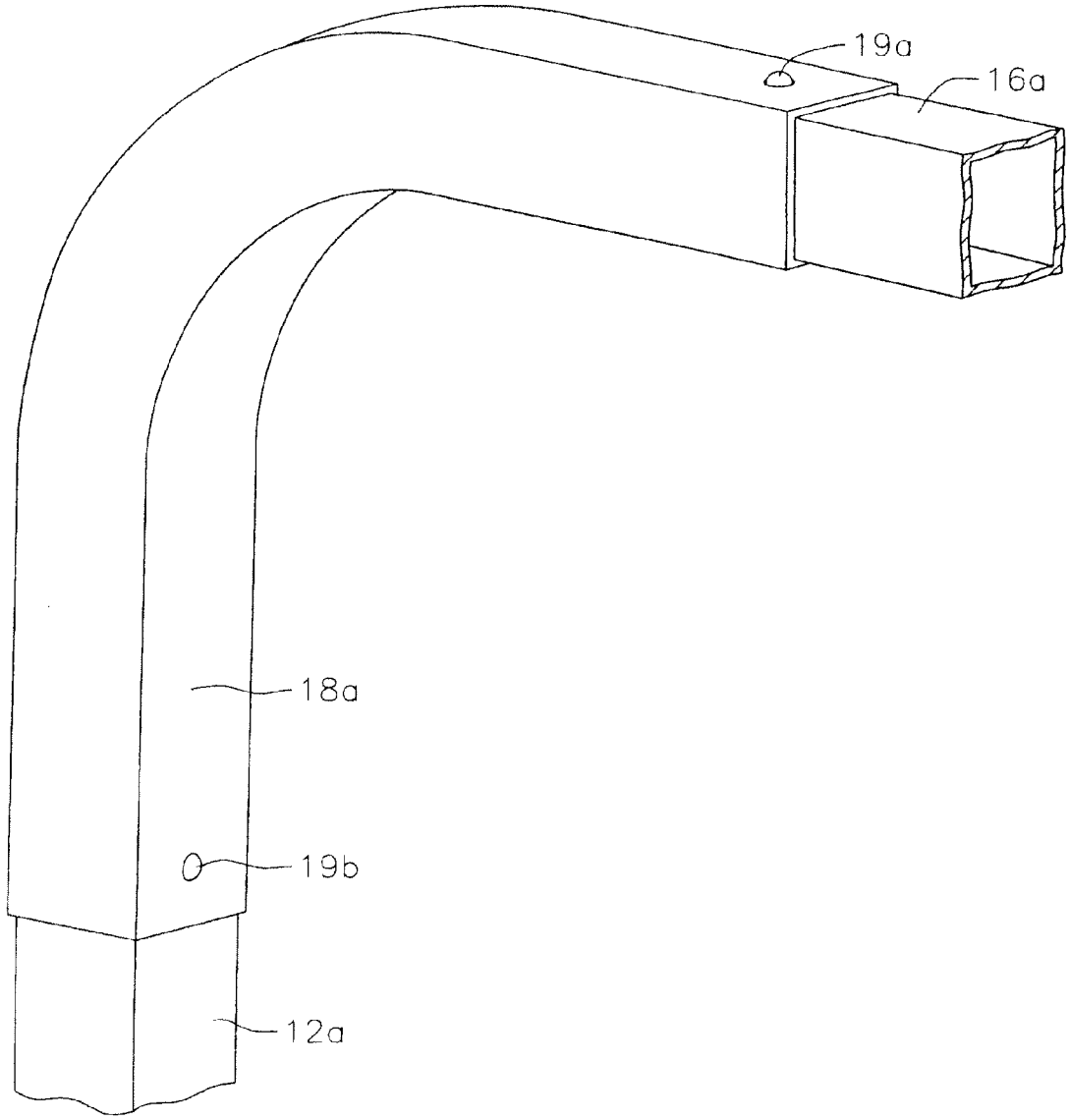
FIG. 3A PRIOR ART
FIGS. 3A and 3B are perspective views showing alternative forms of a prior art corner connector.
Figure 3B:
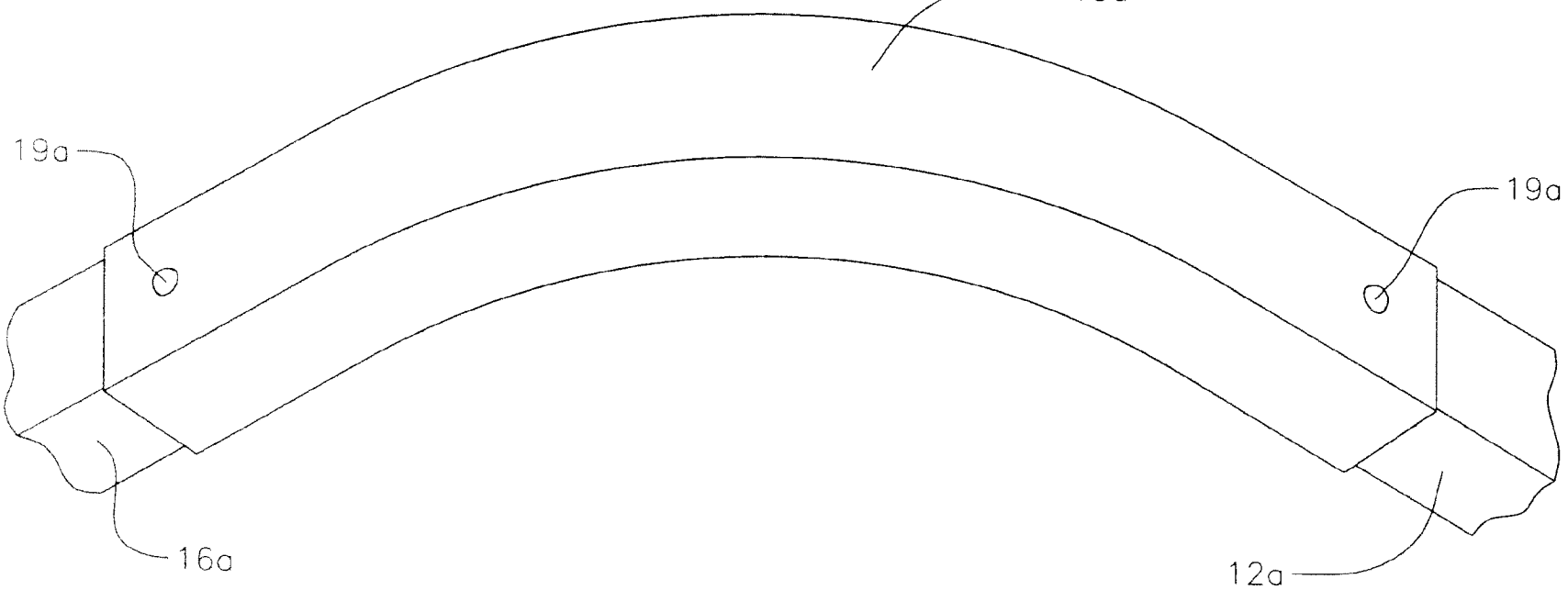
FIG. 3B PRIOR ART

FIGS. 3A and 3B are perspective views showing an alternative corner connector 18*a*. In this form of the invention, the metal tubular right angle corner connectors are enlarged in interior configuration relative to the side members and the end members. During assembly the side members, such as side member 12*a*, slide into a corresponding rectangular-shaped end openings in the corner connector 18*a*; and likewise, the end members, such as end member 16*a*, slide into corresponding end openings in the corner connector 18*a*. The end portions of the side members and the end members carry spring-biased locking devices that make a releasable snap-fit in a corresponding hole drilled in an end portion of the corner connector. FIGS. 3A and 3B show locking devices 19*a* on the outside portions of the side member 12*a* and end member 16*a* that engage holes in the outer end portions of the corner connector. FIG. 3A also shows a spring-biased locking device 19*b* on an inside portion of the side member 12*a*. The locking devices 19*a* and 19*b* are positioned to snap-lock simultaneously with the holes in the corner connectors during assembly.

Figure 4:
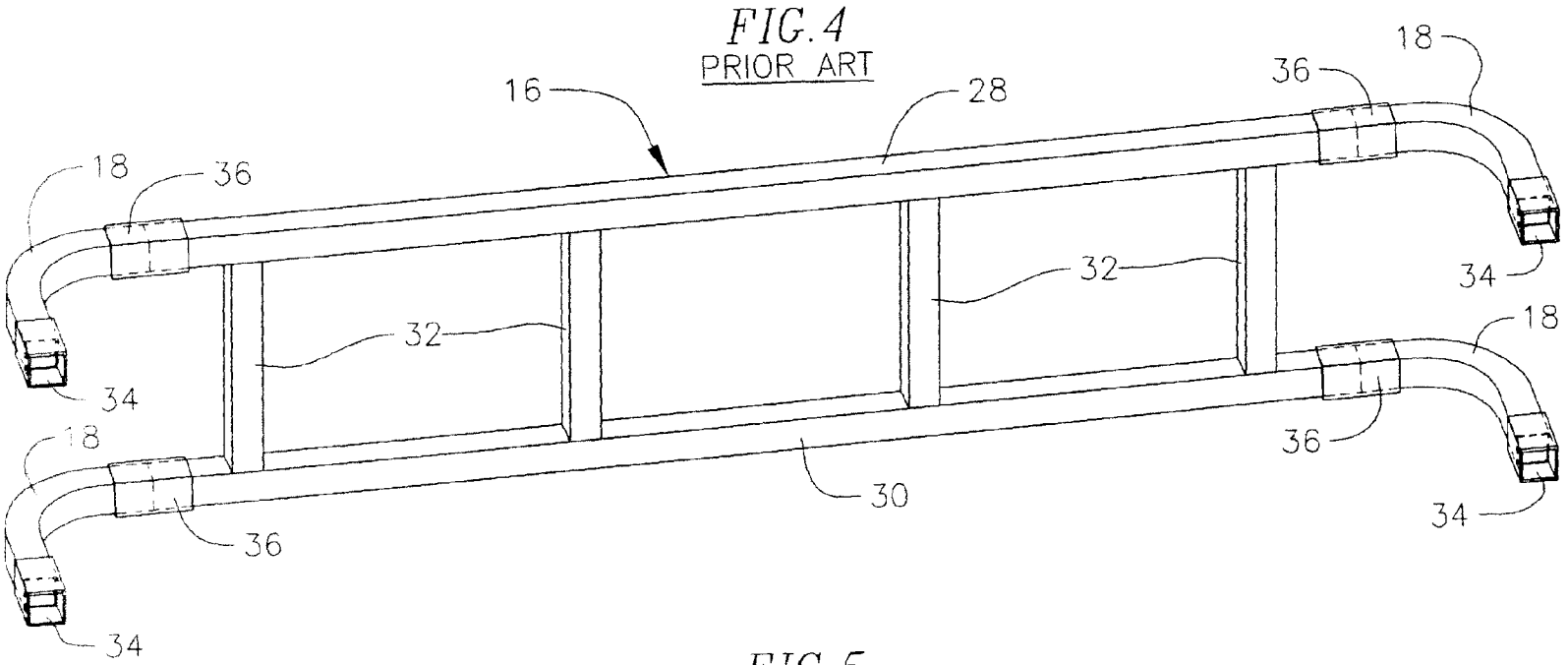
FIG. 4 PRIOR ART
Figure 5:
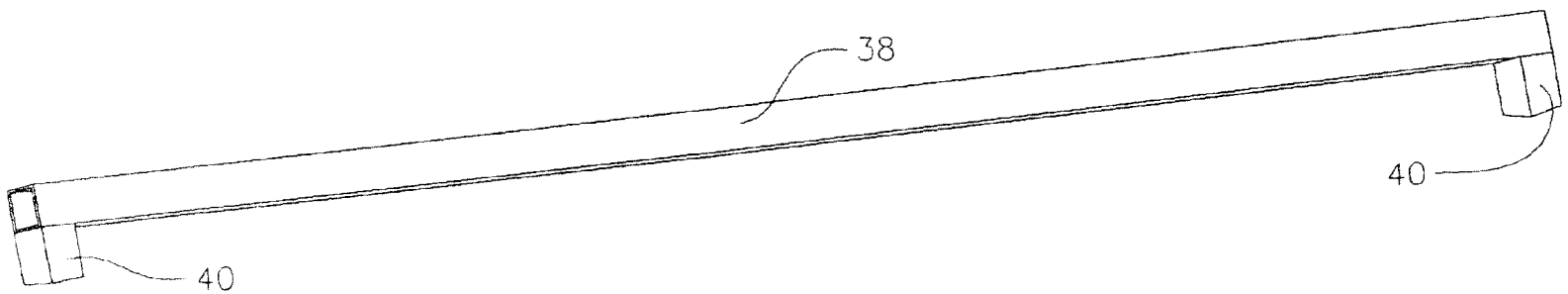
FIG. 5 PRIOR ART

FIG. 4 illustrates a partly assembled form of the foundation in which each end frame 16 has four corner connectors releasably attached to the upper and lower ends of the end frame, each making a right angle bend so that the open sleeve portions 34 of the corner connectors face in the direction to receive the end portions of corresponding side frame members 22 or 24.

The foundation assembly further includes a plurality of longitudinally spaced apart tubular rigid metal slats 38 extending parallel to one another between the left and right side frames. Each slat includes side frame connection members 40 at opposite ends of each slat projecting in the same general direction away from the slat. The slats and the connection members 40 are preferably rectangular in cross-section. The side frame connection members 40 extend perpendicular to the axis of slat 38.

Figure 6:
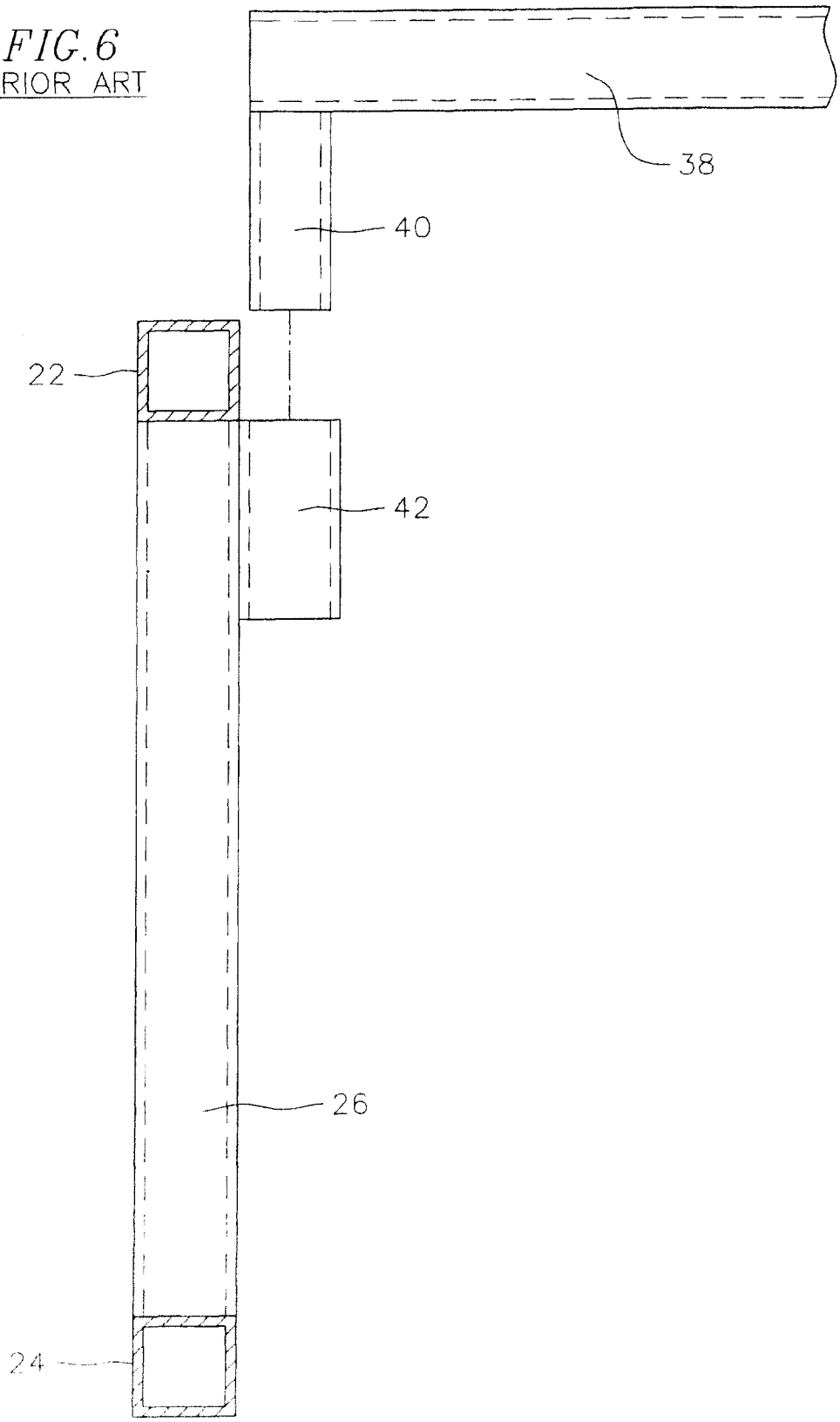
FIG. 6 PRIOR ART

Referring to FIG. 6, each of the first upright bracing members 26 carries a separate rigid tubular metal slat connector sleeve 42 preferably having a rectangular cross-sectional configuration. The slat connector sleeves open upwardly and are shaped and sized to slidably receive the rectangular shaped and downwardly projecting side frame connector members 40 at the ends of the slats 38. Thus, in assembling the foundation, separate rigid slat connector sleeves 42, which are affixed to the first bracing members, slidably receive corresponding ones of the side frame connection members 40 on the slats. The assembled slats are held in fixed spaced apart positions extending parallel to one another between both sides of the side frames and along the length of the box-frame formed by the side and end frames of the assembled foundation. The assembled slats maintain the rigidity of the assembled foundation.

Figure 7:
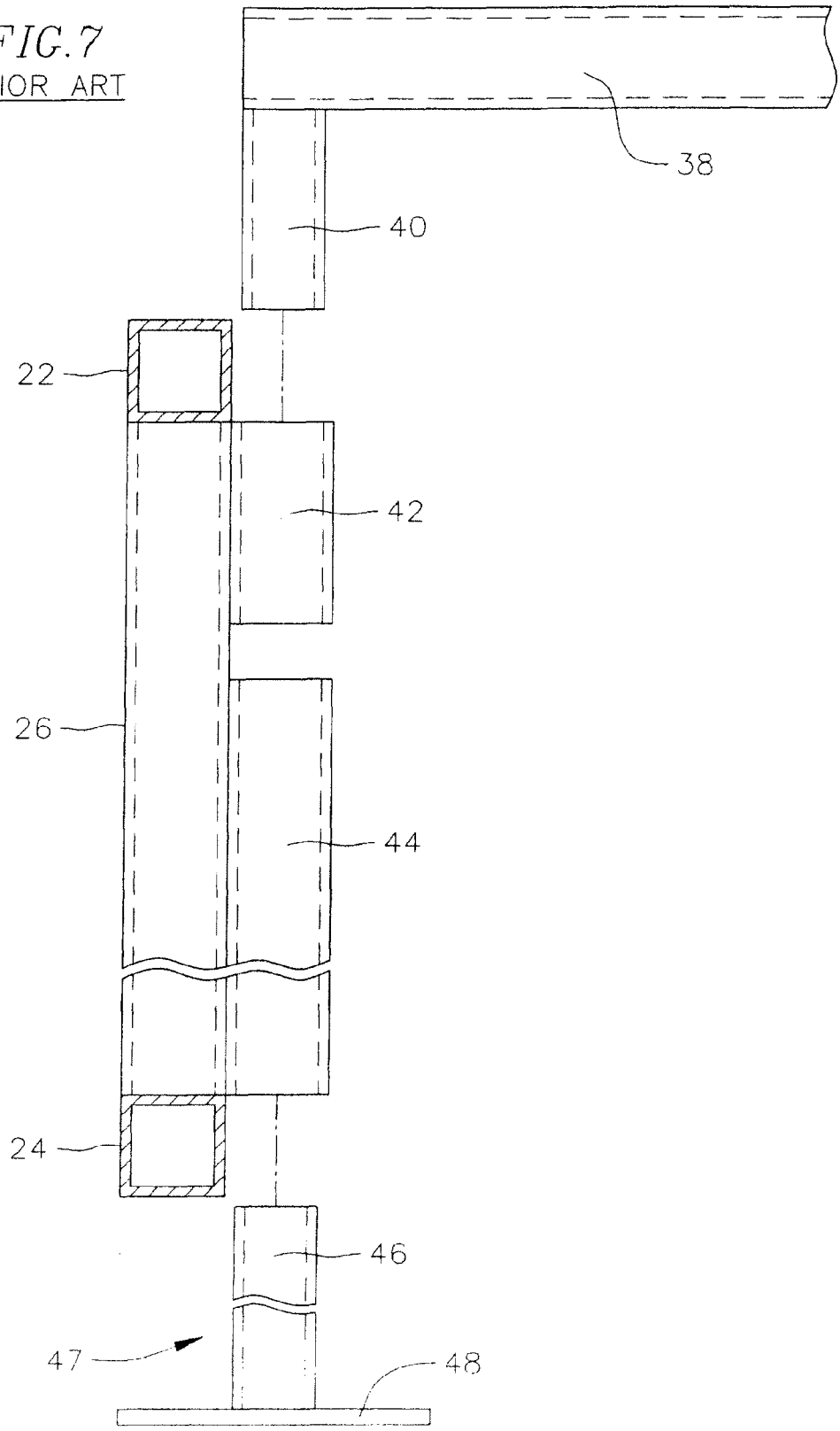
FIG. 7 PRIOR ART

Referring to FIG. 7, selected ones of the first upright bracing members 26 also carry a rigid tubular metal leg connector sleeve 44 having a rectangular cross-sectional configuration. The leg connector sleeves open downwardly to slidably receive separate elevating feet 47 for holding the foundation, in its assembled form, elevated above the floor. The elevating feet comprise a separate upright rigid metal leg member 46 of rectangular cross-sectional configuration rigidly affixed to a horizontally extending foot section 48. The separate leg connectors 44 are configured to slidably receive corresponding ones of the leg members 46 for rigidly maintaining the leg members in a fixed position to support the foundation above the floor. A stop (not shown) is located in each of the leg connectors 44 to engage the upper end of the leg 46 so that each of the leg portions of the elevating feet can be spaced a uniform distance above the floor when the legs 46 are assembled in the leg connector sleeves 44.

Thus, the modular foundation assembly provides ladder-like side frames with upper and lower side rails and ladder-like end frames with upper and lower end rails. The side and end frames slidably attach to the ends of the upper and lower rounded right angle corner rails. The assembled corner connectors hold the side frames and end frames together to form a rectangular box-frame structure. The insides of the side frames carry tubular fittings that provide connector sleeves that receive corner connectors on the ends of spaced apart slats that traverse the width of the box-frame when assembled by the user. The slats extend parallel to one another, perpendicular to the side frames, to provide lateral rigidity between the side frames. The elevating feet can be positioned near the four corners of the assembled frame structure. The leg portions of the feet are slidably connected to the socket-like openings in tubular fittings on the undersides of the side frames. The feet elevate the assembled foundation above the floor.

The following description provides one example of the components of the foundation assembly can be provided so as to form either twin, full or double, queen and king size bed foundations.

Full, double and twin size foundations are approximately 5 to 6 feet long, queen size is approximately 6 to 6½ feet long, and king size is approximately 7 feet long. In each instance the slats (and their related bracing members on the side frames) have approximately 12 inch spacing. The frame members described below are preferably made of tubular steel, rectangular in cross-section, preferably made from 16 to 19 gauge steel.

The tubular upper and lower side members 22 and 24 of the side frames are ¾×¾ inch square in cross section.

The upper and lower end members 28 and 30 also are preferably ¾×¾ inch square in cross section.

The tubular corner connectors 18 are preferably ¾×¾ inch in cross section. The sleeves 34 and 36 at their ends are approximately ⅞×⅞ inch square in cross section.

Alternatively, the corner connectors can be ⅞×⅞ inch square in cross-section from one end to the other to receive the upper and lower side and end members in a snap fit.

The first and second bracing members 26 and 32 for the side and end frames are spaced apart by about 12 inches and are approximately ¾×¾ inch square in cross section.

For a twin size foundation, the slats 28 and their side frame connection members 40 are ¾×¾ inch in cross section. For full, double, queen or king size foundations, the slats form an integral length of metal tubing each having an outside dimension of ¾×1½ inches in height and width, respectively. Each slat carries a single ¾×¾ inch side frame connection member at each of its ends.

The tubular slat connector sleeves 42 on the upper insides of the left and right side frames are ⅞×⅞ inch square in cross section.

The leg connector sleeves 44 on the lower insides of the left and right side frames also are ⅞×⅞ inch square in cross section.

The leg sections 46 of the elevating feet 47 are preferably ¾×¾ inch square in cross section.

The height of the first and second bracing members of the side frames and end frames can vary in length between about 3 inches for a low profile foundation up to about 8 inches in length for a higher profile foundation.

Figure 8:
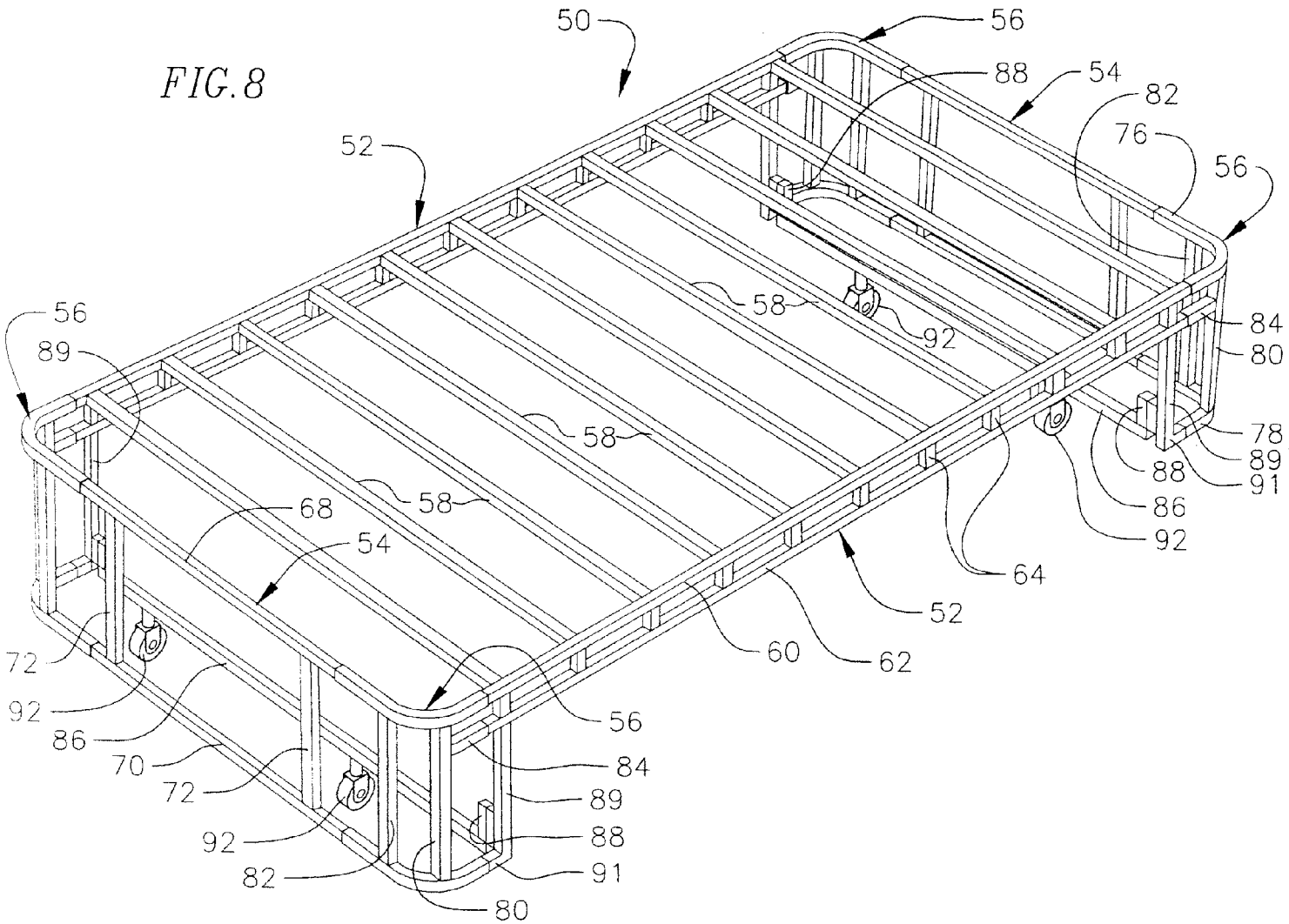
FIG. 8 is a perspective view showing one embodiment of the invention in which the modular bed frame foundation is configured and arranged to provide storage space for a second bed, such as a trundle bed.
Figure 10:
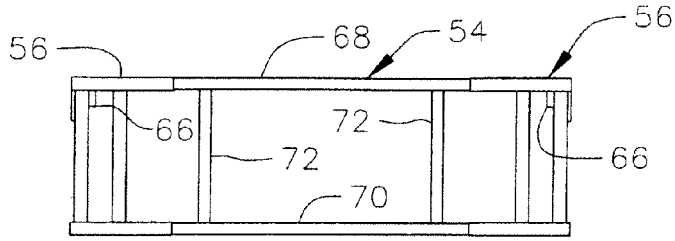
FIG. 10 is an end elevational view taken on line 10-10 of FIG. 9.
Figure 9:
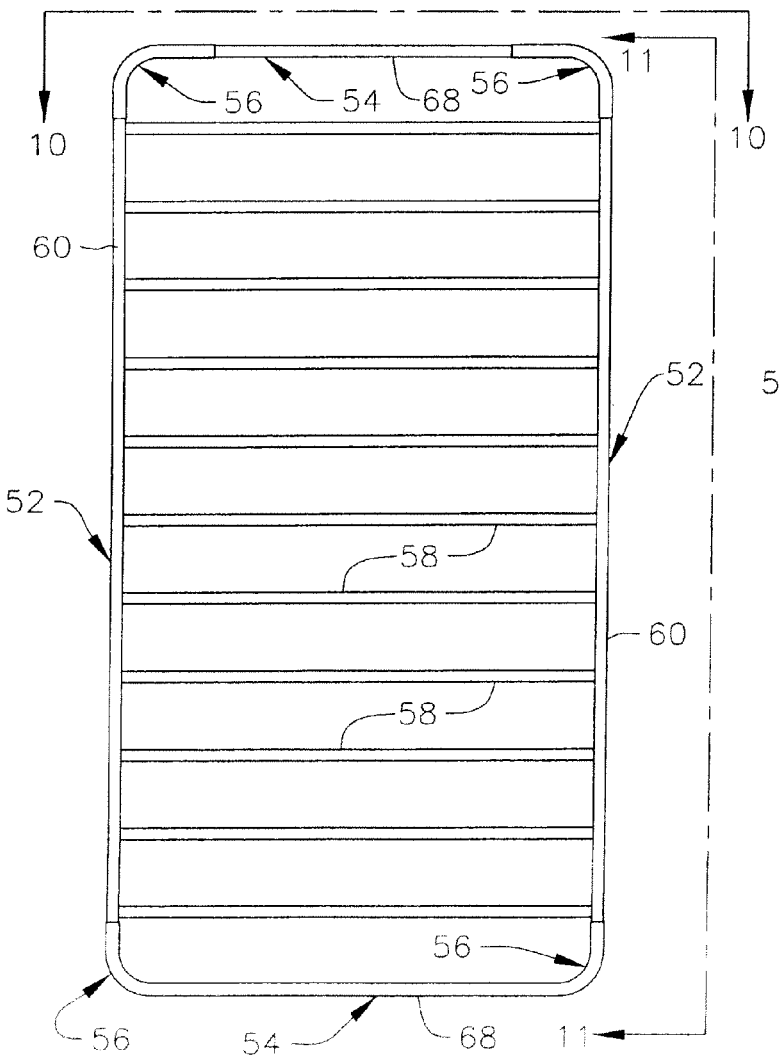
FIG. 9 is a top plan view of the bed frame assembly shown in FIG. 8.
Figure 11:
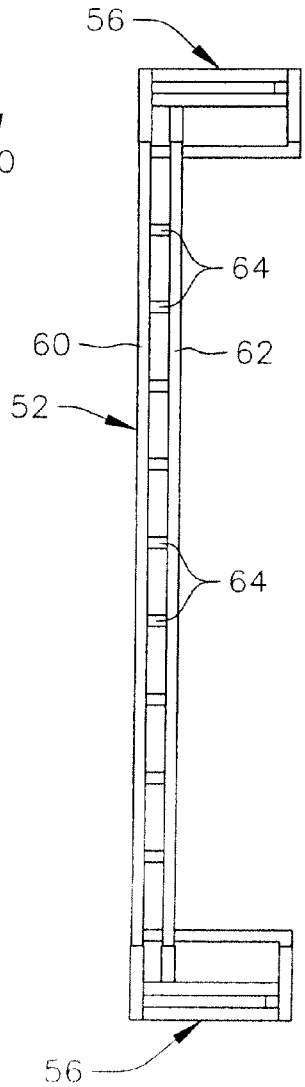
FIG. 11 is a side elevational view taken on line 11-11 of FIG. 9.
Figure 12:
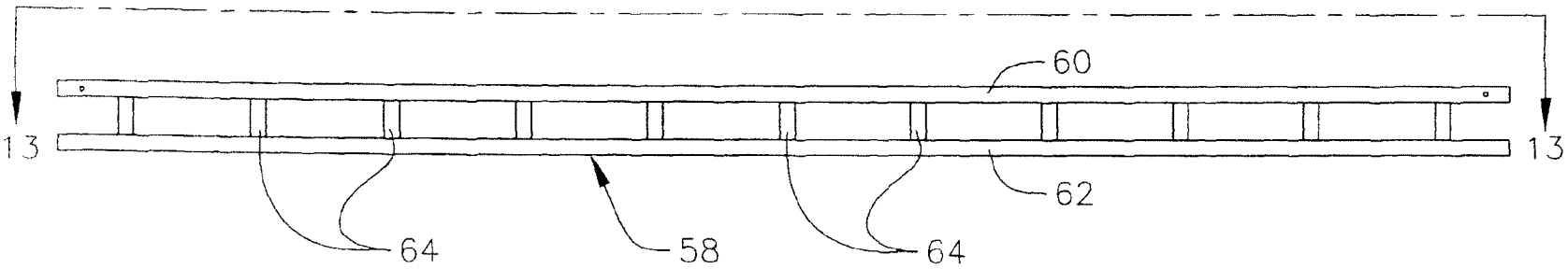
FIG. 12 is a side elevational view of a side frame used in the bed frame assembly shown in FIG. 8.
Figure 13:
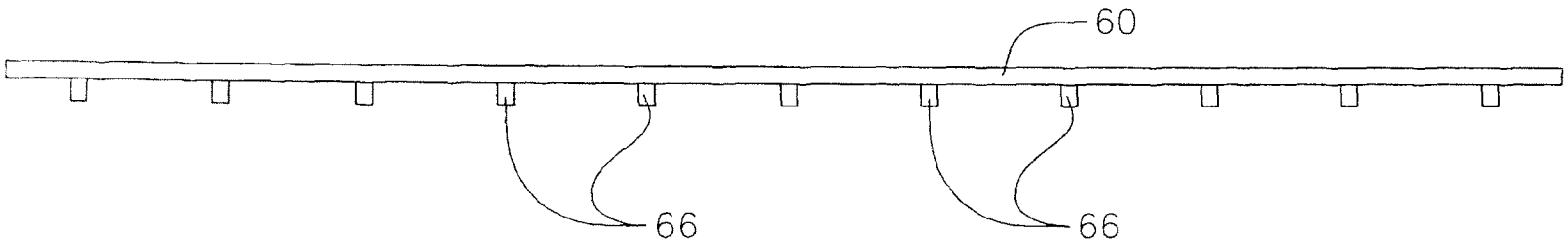
FIG. 13 is a top elevational view taken on line 13-13 of FIG. 12.
Figure 14:
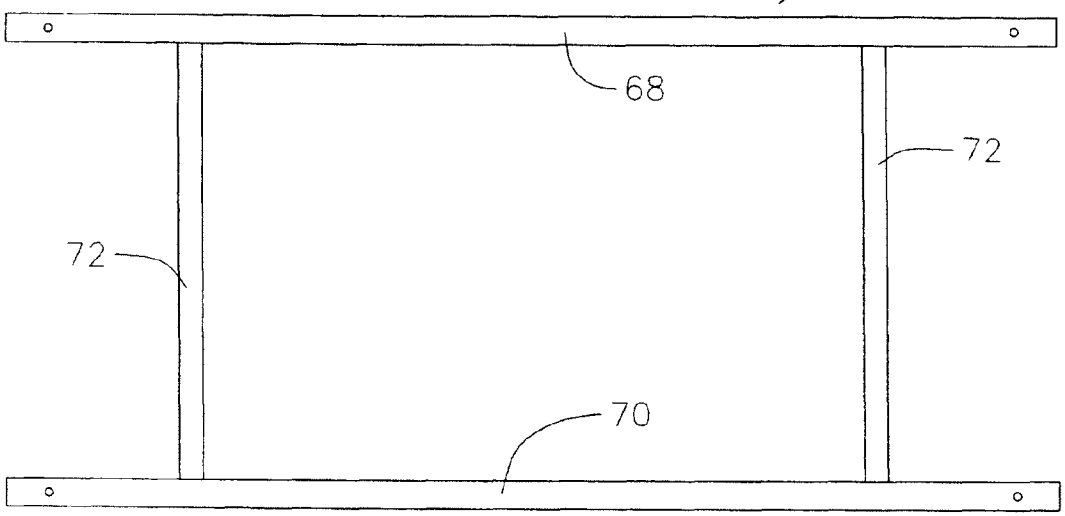
FIG. 14 is an elevational view of an end frame used in the foundation assembly shown in FIG. 8.
Figure 15:
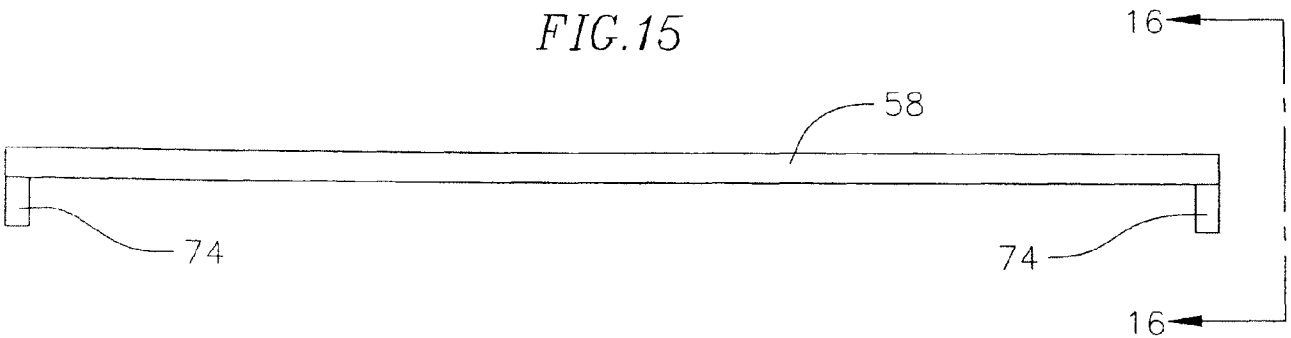
FIG. 15 is a side elevational view showing one of a plurality of slats used in the assembly shown in FIG. 8.
Figure 16:
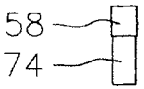
FIG. 16 is an end elevational view taken on line 16-16 of FIG. 15.

FIGS. 8 to 23 illustrate one embodiment of a space-saving tubular metal bed foundation assembly 50 configured and arranged to provide storage space beneath the foundation assembly for a second bed, such as a trundle bed. FIG. 8 shows the space-saving foundation 50 in its assembled form, the components of which are illustrated in FIGS. 9 to 22. Briefly, the FIG. 8 foundation assembly includes left and right ladder-like side frames 52, respectively, front and rear ladder-like end frames 54, respectively, and separate corner connector assemblies 56 at the four corners of the foundation assembly. A plurality of longitudinally spaced apart, laterally extending tubular rigid metal slats 58, similar to those described previously, extend parallel to one another between the left and right side frames.

Referring to FIGS. 9 to 15, the left and right side frames 52 include corresponding upper and lower elongated tubular rigid metal side members 60, 62, respectively, spaced apart vertically and extending substantially parallel to one another. A plurality of corresponding longitudinally spaced apart rigid metal bracing members 64 are rigidly affixed, such as by welding them at their ends, to extend parallel to one another to support the upper and lower side members. In one embodiment, each ladder-like side frame has a long, narrow profile.

The vertical bracing members 64 are relatively short with a length preferably less than the combined width of the upper and lower frame members 60, 62. In one embodiment, the length of the side frames 52 is at least about 20 times its height; and the vertical bracing members 64 are about 1.5 inches in length, with the upper and lower side frame members 60, 62 being approximately ¾ to ⅞ inch in width.

The side frame members include rigid metal open-ended sleeves 66, similar to the connector sleeves 42, rigidly affixed, preferably by welding, to the inside of each upright bracing member 64 along the length of the foundation.

The end frames 54 are similar to the end frames in the embodiment of FIG. 1. The end frames comprise corresponding upper and lower tubular rigid metal end members 68, 70, respectively, spaced apart vertically and extending parallel to one another. A plurality of corresponding laterally spaced apart rigid bracing members 72 are rigidly affixed in upright positions extending parallel to one another for supporting the upper and lower tubular end members. The bracing members are preferably tubular metal frame members welded at their opposite ends to the upper and lower end members to form a rigid frame.

The rigid metal slats 58 are each preferably rectangular in cross-section with elongated side frame connection members 74 (similar to connection members 40) at opposite ends of each slat projecting the same general direction, generally at a right angle, away from the slat. The side frame connection members are preferably rectangular in cross-section.

The slat connector sleeves 66 open upwardly and are shaped and sized to slidably receive the rectangular-shaped and downwardly projecting side frame connector members at the ends of the slats. Thus, in assembling the foundation, separate rigid slat connector sleeves 66 which are affixed to the vertical bracing members 64 slidably receive corresponding ones of the connection members on the slats. The assembled slats are held affixed spaced apart positions parallel to one another between both sides of the frames to maintain the rigidity of the assembled foundation.

Figure 18:
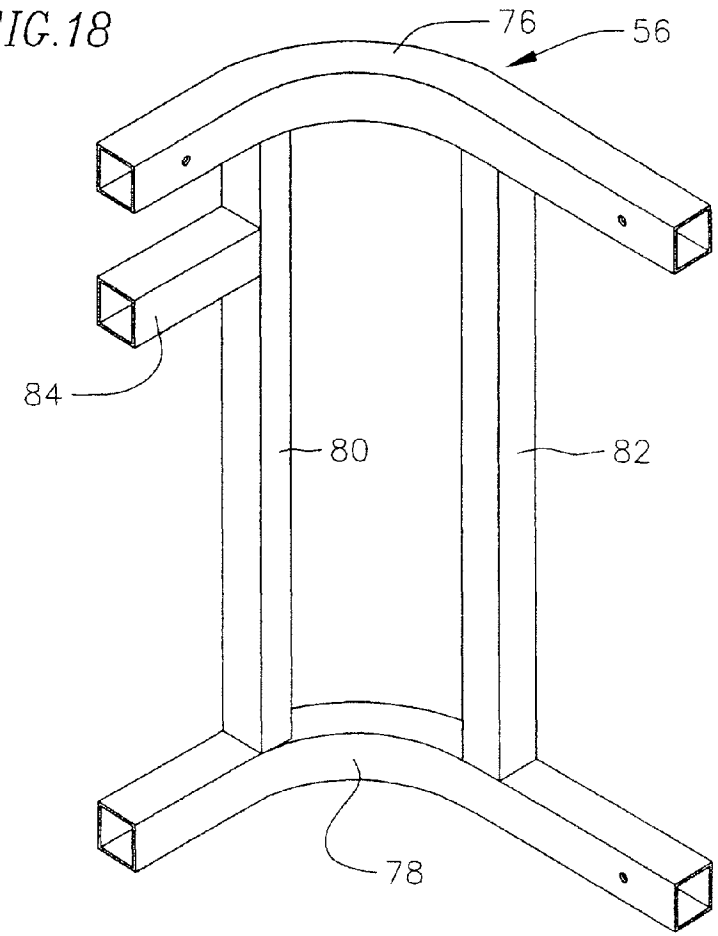
FIG. 18 is a second perspective view of the corner connector assembly of FIG. 17.
Figure 17:
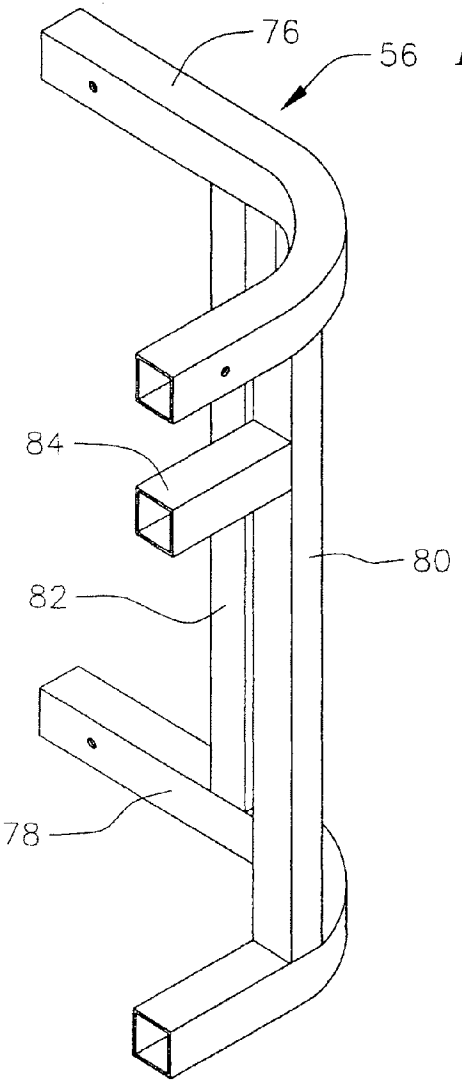
FIG. 17 is a first perspective view showing one embodiment of a corner connector assembly according to principles of this invention.

The corner connector assemblies 56 are shown best in FIGS. 17 and 18. Each corner connector comprises a rigid metal upper frame member 76 which is tubular in cross section and bent into a generally right angle configuration with a rounded central section. The end portions of the upper frame member 76 extend in alignment with the upper frame members 60 and 68 of the side frame and the end frame, respectively. The corner connector assemblies also comprise a rigid metal lower frame member 78 which is tubular in cross-section and bent into a generally right angle configuration with a rounded corner section spaced below the rounded corner section of the upper frame member 76. One end portion of the lower frame member 78 extends generally in alignment with the lower frame member 70 of the end frame 54. The opposing end of the lower corner frame member extends generally in alignment with a lower portion of the side frame 52.

The corner assemblies also include a pair of parallel rigid tubular metal upright bracing members 80, 82 rigidly affixed, such as by welding, to the upper and lower corner members. The bracing members rigidly support the upper and lower corner members 76, 78 as a rigid structure and are parallel to one another at the corners of the assembled foundation.

Each corner connector assembly 56 also includes a rigid tubular open ended sleeve member 84 positioned for alignment with the corresponding end of a left or right side frame member 62. Each sleeve member 84 is rigidly affixed to a corresponding bracing member 80, preferably by welding, to extend parallel to and in vertical alignment with the end portion of the upper corner member 76.

Figure 19:
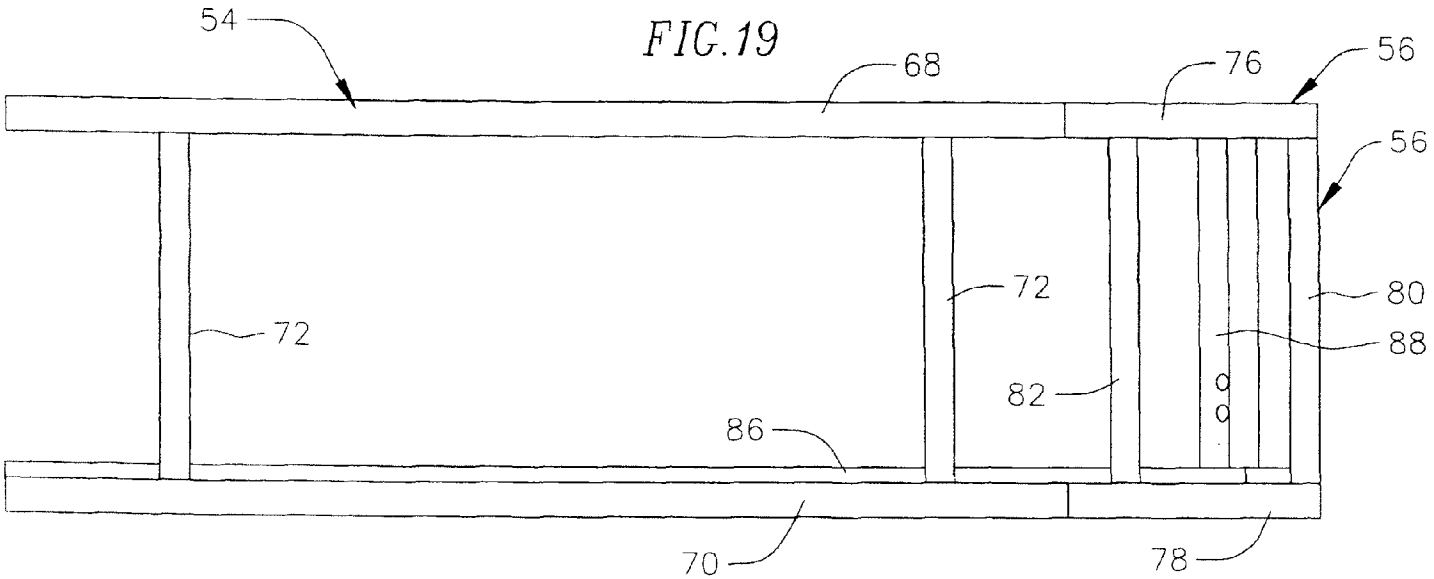
FIG. 19 is an end elevational view showing one embodiment of an assembly for providing a foot structure for elevating the foundation.
Figure 20:
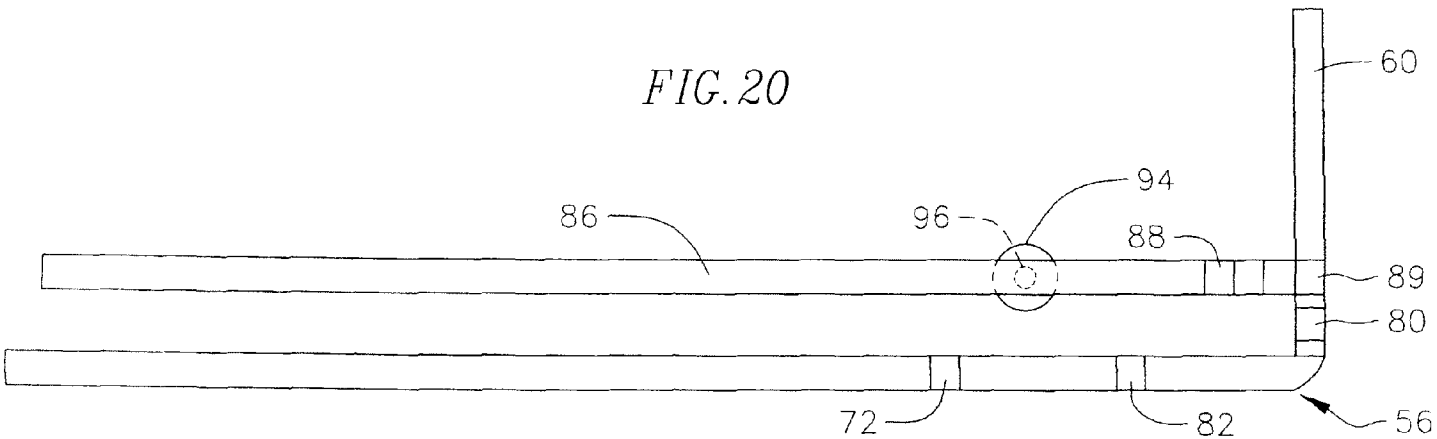
FIG. 20 is a top view of the assembly shown in FIG. 19.

FIGS. 19 and 20 show one embodiment of a means for elevating the foundation assembly above the floor. In this embodiment, a separate bottom slat 86 extends across the lower portion of the foundation, inboard from each end of the foundation. Each bottom slat preferably has the same construction as the slats 58 used in the upper portion of the foundation. The bottom slats are slidably engaged with separate slat-receiving tubular metal sleeves 88 rigidly affixed inboard from inwardly facing portions of the side frame members 52, near the ends of the foundation. In the illustrated embodiment, the metal sleeves 88 are affixed to inside portions of upright tubular metal end frame members 89 rigidly connected to the lower side rail members 62 of the side frames 52. The end frame members 89 carry tubular bottom connectors 90 for slidably connecting to open-ended portions of the lower frame members 78 of the corner connectors 56. The vertical end connectors on the bottom slats slide upwardly into the sleeves 88 to hold the bottom slats 86 in place, positioned inboard from and parallel to the end frames 54 of the foundation. The lower portions of the bottom slats 86 carry rollers or casters 92 (see FIG. 1) for elevating the foundation. In one embodiment, a metal plate 94 is affixed to the bottom of the slat and carries a downwardly facing internally threaded nut 96 (see FIG. 21) to receive a threaded leg 98 or similar fastener on the caster or roller 92.

Figure 21:
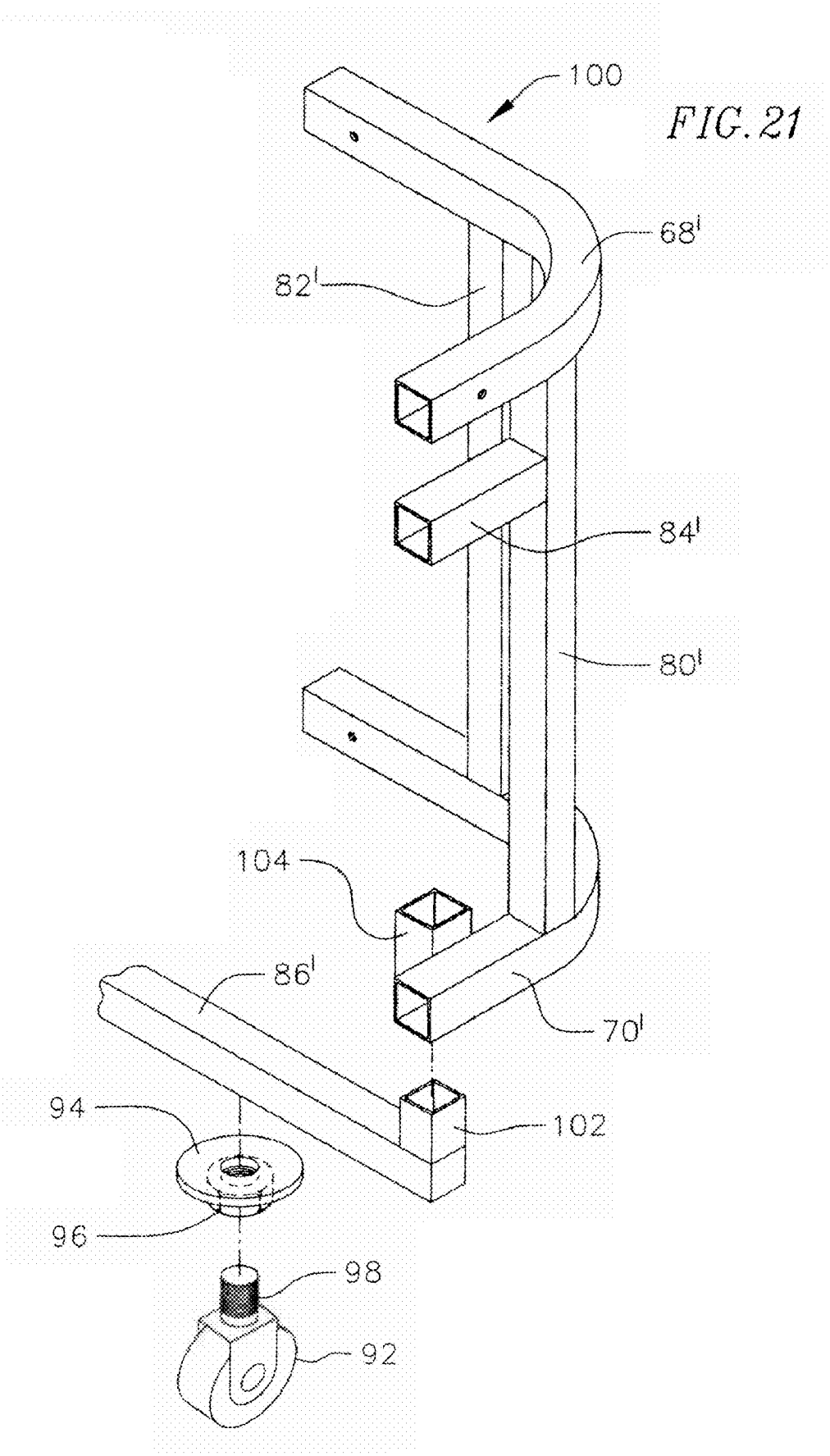
FIG. 21 is a first perspective view showing an alternate embodiment of a corner assembly and a means for elevating the foundation.
Figure 22:
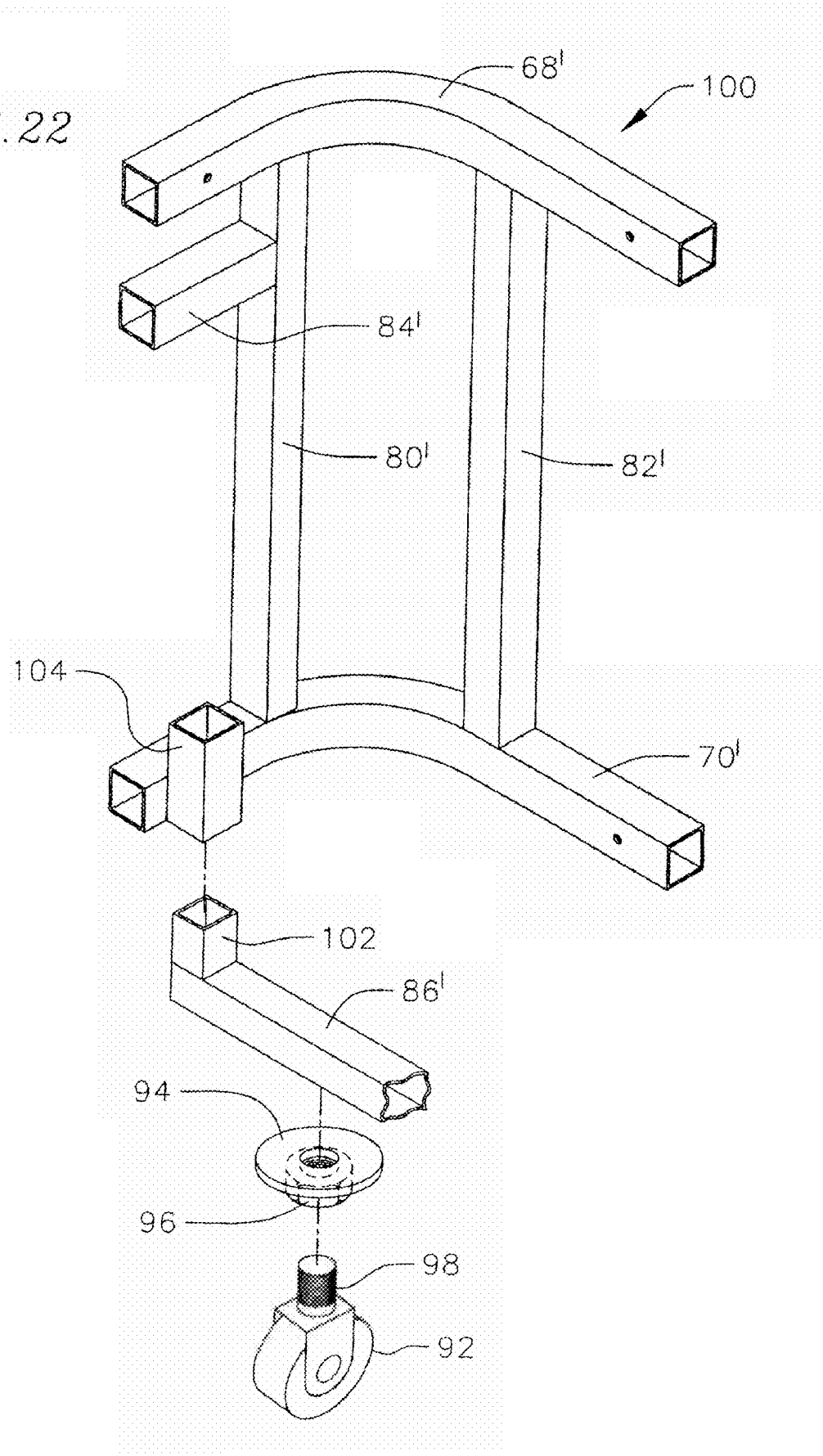
FIG. 22 is second perspective view of the assembly shown in FIG. 21.

FIGS. 21 and 22 show an alternate embodiment of a corner connector assembly containing a foundation-elevating assembly. In this embodiment, the corner connector assembly 100 includes an upper corner rail 76', a lower corner rail 78', bracing members 80' and 82', and a side frame connector sleeve 84' similar to those described previously. Each bottom slat 86' is secured to the lower inside portions of the corner connector assemblies at each end of the foundation. The end connectors 102 at opposite ends of the slats 86' are slidably engaged with upright tubular metal sleeves 104 affixed to inside portions of the corner rails 70'. This positions the lower slats inboard from the ends of the assembled foundation, between and supported by the two corner connector assemblies 56 at the ends of the assembled foundation. The bottom slats 86' carry the rollers 92 connected to the metal plates 94 on the undersides of the slats 86'.

Figure 23:
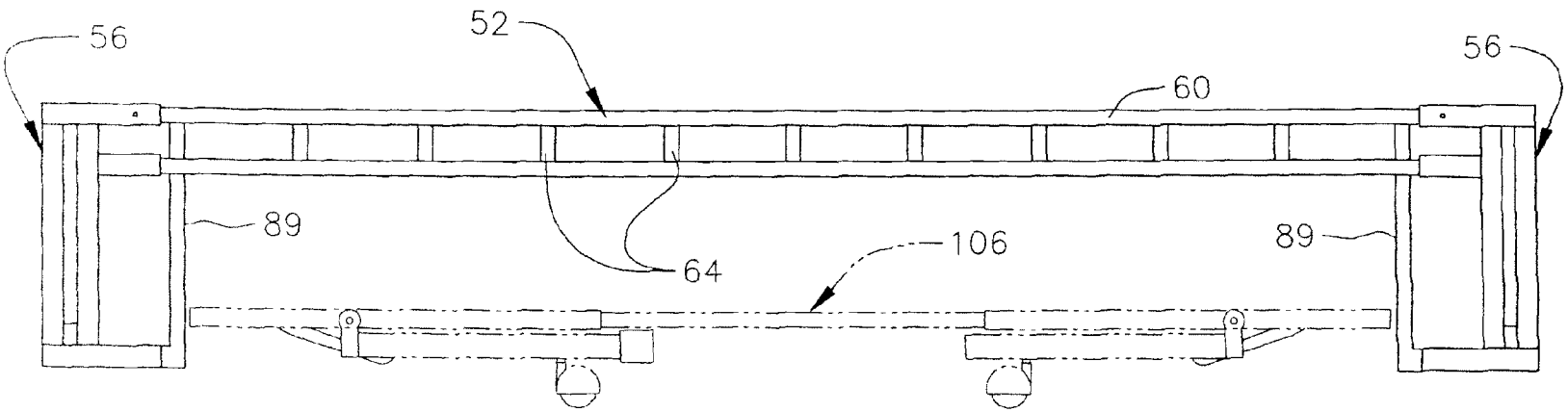
FIG. 23 is a side elevational view showing the storage space provided by the modular foundation frame construction for a second bed such as a trundle bed.

FIG. 23 illustrates the space-saving improvement of the invention, in which a folded bed frame or trundle bed 106 can slide into the open space beneath the assembled foundation. Each can be used to support a separate mattress.

What is claimed is:

1. A space-saving modular bed foundation assembly for supporting a mattress, the assembled foundation comprising:

a pair of laterally spaced apart and parallel left and right side frames;

a pair of longitudinally spaced apart and parallel left and right end frames;

the left and right side frames each comprising upper and lower elongated tubular rigid metal side members spaced vertically apart and extending substantially parallel to one another, and a plurality of longitudinally spaced apart first rigid metal bracing members rigidly affixed in upright positions supporting the upper and lower tubular side members of each side frame;

the left and/or right side frame having a narrow profile with a height sufficiently offset from the height of the end frames to provide an open space beneath the assembled foundation for receiving a second bed frame;

the left and right end frames each comprising upper and lower elongated tubular rigid metal end members spaced vertically apart and extending substantially parallel to one another, and a plurality of laterally spaced apart second rigid metal bracing members rigidly affixed in upright positions supporting the upper and lower tubular end members of each end frame;

separate one-piece corner connector assemblies for holding the side frames parallel to one another and the end frames parallel to one another to form a rectangular box-frame structure of the assembled bed foundation;

the corner connector assemblies each comprising an upper corner connector having a generally right angle profile for slidably connecting end portions of the upper side members to corresponding end portions of adjacent upper end members, a lower corner connector having a generally right angle profile for slidably connecting to an end portion of an adjacent lower end member, and at least a pair of upright bracing members rigidly affixed to the upper and lower corner connectors to form a rigid corner assembly;

a plurality of longitudinally spaced apart rigid metal slats extending parallel to one another between the left and right side frames, each slat including side frame connection members at opposite ends of each slat projecting in the same general direction away from the slat; and separate rigid slat connectors rigidly affixed to selected ones of the first bracing members and configured to slidably receive corresponding ones of the side frame connection members on the slats for holding the plurality of slats in fixed spaced apart positions extending parallel to one another between both sides of the side frames along the length of the box-frame formed by the assembled side and end frames of the foundation.

2. Apparatus are to claim 1 including a lower bed-elevating support structure comprising (a) or (b):

(a) a laterally extending bottom slat extending between lower inside portions of the side frames, a separate connector sleeve to slidably receive ends of the bottom slat on the side frames, and a foundation-elevating connection to a roller, caster or foot on the bottom slat;

(b) a laterally extending bottom slat extending between lower inside portions of the corner connector assemblies, a separate connector sleeve to slidably receive ends of the bottom slat on the lower corner connectors, and a foundation-elevating connection to a roller, caster, or foot on the bottom slat.

* * * * *